US005520325A

United States Patent [19]

Quaintance

[11] Patent Number: 5,520,325

[45] Date of Patent: May 28, 1996

[54] CHANNEL H DIVIDER PACK

[75] Inventor: Benjamin W. Quaintance, Germantown, Tenn.

[73] Assignee: International Paper Company, Purchase, N.Y.

[21] Appl. No.: 370,072

[22] Filed: Jan. 6, 1995

[51] Int. Cl.[6] ..... B65D 25/04

[52] U.S. Cl. ..... 229/120.26; 229/120.29; 229/240

[58] Field of Search ..... 229/120.24, 120.26, 229/120.29, 120.37, 120.38, 125.33, 191, 240; 206/45.12, 45.13

[56] References Cited

U.S. PATENT DOCUMENTS

| | | | |
|---|---|---|---|
| Re. 26,557 | 3/1969 | Houston . | |
| 3,260,440 | 7/1966 | Foley . | |
| 3,348,667 | 10/1967 | Beeby . | |
| 3,425,544 | 2/1969 | Ayer . | |
| 3,653,495 | 4/1972 | Gray | 206/45.12 |
| 3,810,573 | 5/1974 | Russell et al. | 229/125.33 X |
| 3,921,893 | 11/1975 | Randle, Jr. | 229/120.24 X |
| 3,985,286 | 10/1976 | Hicks . | |
| 4,282,999 | 8/1981 | Moen . | |
| 4,427,108 | 1/1984 | Coles . | |
| 4,635,795 | 1/1987 | DeFlander . | |
| 4,779,737 | 10/1988 | Umehara et al. | 229/120.24 |
| 4,793,494 | 12/1988 | Gordon, Jr. | 229/240 X |
| 4,848,651 | 7/1989 | Hartness | 229/240 X |

*Primary Examiner*—Allan N. Shoap
*Assistant Examiner*—Christopher J. McDonald
*Attorney, Agent, or Firm*—Michael J. Doyle

[57] ABSTRACT

A combined shipping and display carton is formed from a plurality of unitary, folded paperboard blanks. The carton has an interior H shaped divider located between top and bottom panel closures, with each closure having vertically extending side and end panels or skirts. The free edges of the skirts are vertically spaced apart. The carton is in the form of a rectangular parallelepiped with a vertical post at each of the four corners. Ends of the side and end skirts of the top and bottom closures are glued to respective corner posts, leaving middle, unglued portions of the skirts. The corners of the top closure panel and the ends of the top closure panel skirts are perforated to permit tearing. After loading the carton with product, typically cylindrical containers, the top closure is glued to the posts. For opening the carton, the middle, unglued portions of the top closure are ripped upwardly, thus removing most of the top closure to thus permit side and top access to the product containers. In another embodiment, there are no perforated lines on the top closure, and the top closure is removed by cutting. In yet another embodiment, the top closure is omitted.

14 Claims, 6 Drawing Sheets

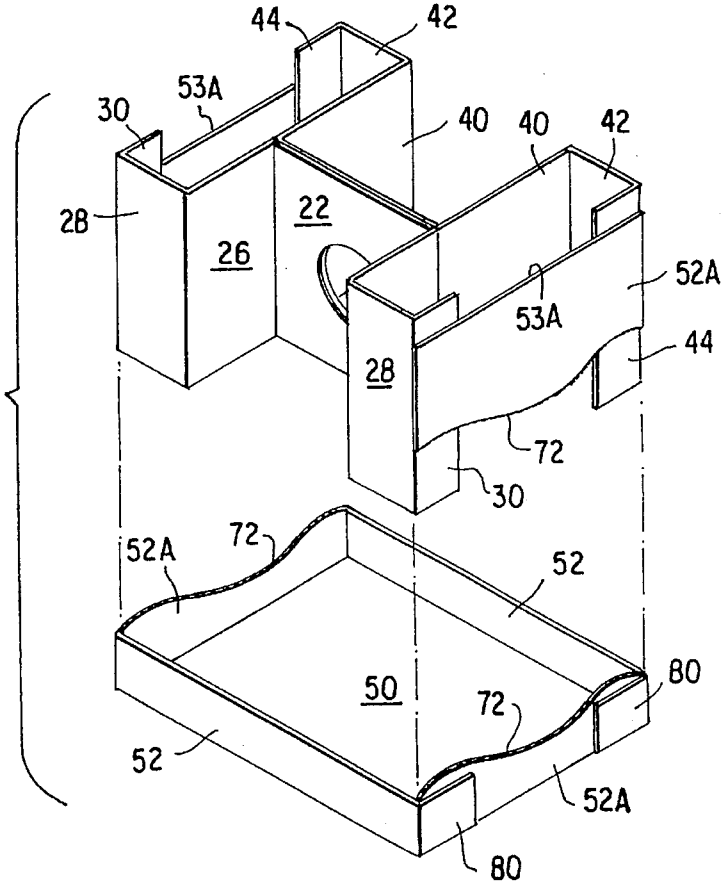
FIG. 14
FIG. 12
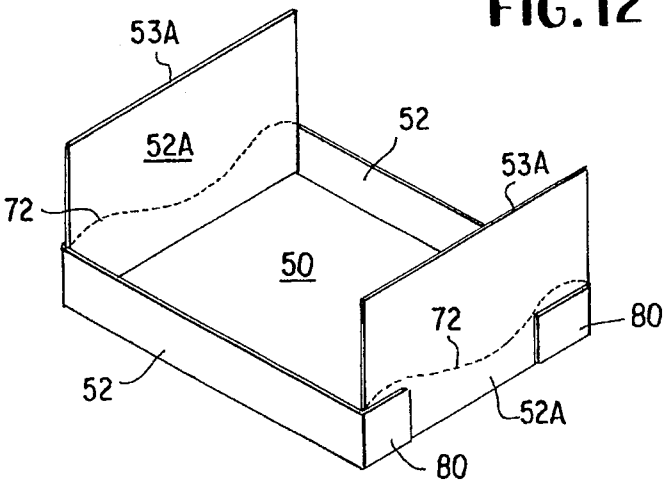
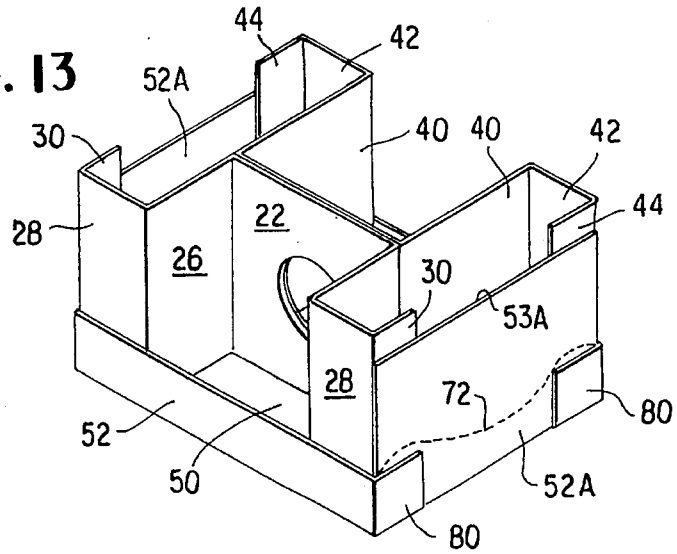
FIG. 13

CHANNEL H DIVIDER PACK

BACKGROUND OF THE INVENTION

This invention relates to paperboard cartons and more particularly to paperboard cartons of the type which both contain products for transport and which are also used for product display. Typically, the products are packaged in metal or paperboard or plastic containers, often cylindrical. Such products include non carbonated beverages, foods, and cleaning fluids.

It is sometimes often desirable in the retail trade to both ship products in a corrugated paperboard carton and then to use the carton as a display carton.

SUMMARY OF THE INVENTION

According to the practice of this invention, a paperboard carton, typically formed of corrugated board, is provided with a top and bottom closure, with the sides of the top and bottom closures being spaced from each other. The carton is in the general form of a rectangular parallelepiped. The interior of the carton is provided with a pair of rectangular, foldable paperboard inserts which, when folded, define a generally H shaped divider. The precise form of the H divider may be varied according to the products packaged in the carton. End portions of the H divider define corner posts of generally L shape.

After receiving the carton with product therein, the retailer need only rip up four portions of the top closure, discard the ripped off top closure, so as to permit substantially full access to the carton interior. This access permits consumers to remove the products directly from the carton. The invention thus obviates the requirement that retail store personnel open the cartons with product therein, remove the product from the cartons, and then stack the product on display shelves, although this customary manner of unloading by store personnel can still be used if desired.

The carton may also be used without a top closure. The carton may be loaded with product and shipped without a top closure and used, without more, as a display ready unit.

BRIEF DESCRIPTION OF THE DRAWINGS

FIG. 12 is perspective view of a carton formed from the blank of FIG. 11.

FIG. 13 is a perspective view of the carton of FIG. 12 with the H divider in it.

FIG. 14 is a perspective view of the carton and divider of FIG. 13 after partial tearing or ripping of the carton.

DETAILED DESCRIPTION OF THE INVENTION

Figure 1:
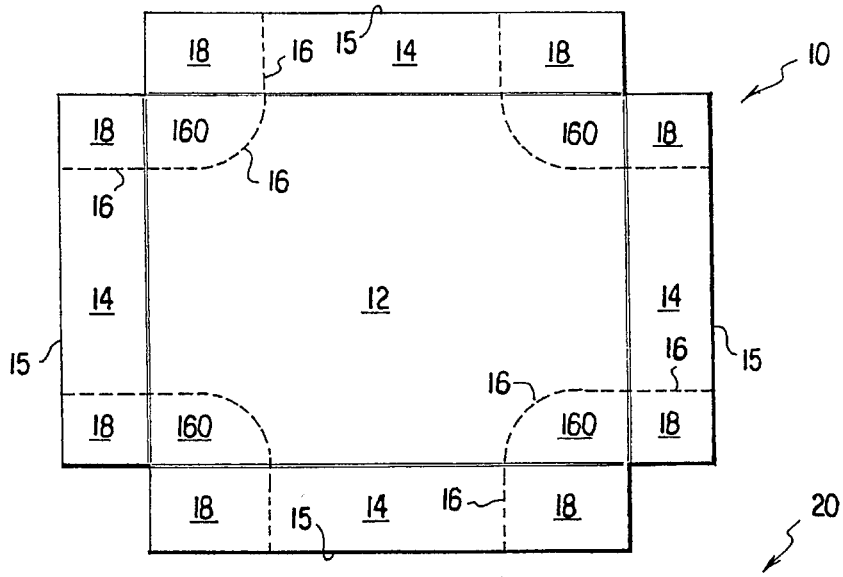
FIG. 1 is a plan view of a unitary blank for forming the carton top closure.

Referring now to the drawings, FIG. 1 illustrates a unitary blank 10 of paperboard, such as corrugated paperboard, which includes a generally square central portion or panel 12 having side and end flaps 14 foldably secured thereto by the indicated fold lines. Four perforated tear lines are located at each of the four corners of blank 10, each tear line denoted as 16. The central portion of each tear line, lying within panel 12, is curved or angled, That portion of each side and end flap 14 between a respective free end thereof and a perforated line 16 is designated as 18, with tear lines 16 spanning the width of each flap 14 and terminating at each free edge 15 thereof. The corner areas of central panel 12 enclosed by perforated lines 16 and the indicated intersecting fold lines are designated as 160.

Figure 2:
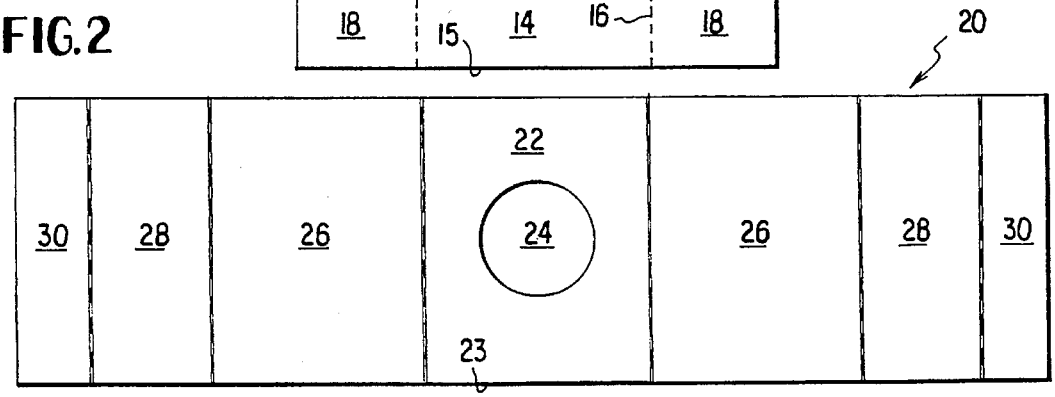
FIGS. 2 and 3 are plan views of typical rectangular paperboard panels for forming an H shaped divider.

FIG. 2 shows a unitary and generally rectangular paperboard blank 20 for forming a portion of the H divider and includes a central panel 22, with panels 26, 27, and 30 joined by the indicated fold lines and extending laterally from both sides of panel 22. Panel 22 includes an opening 24.

Figure 3:
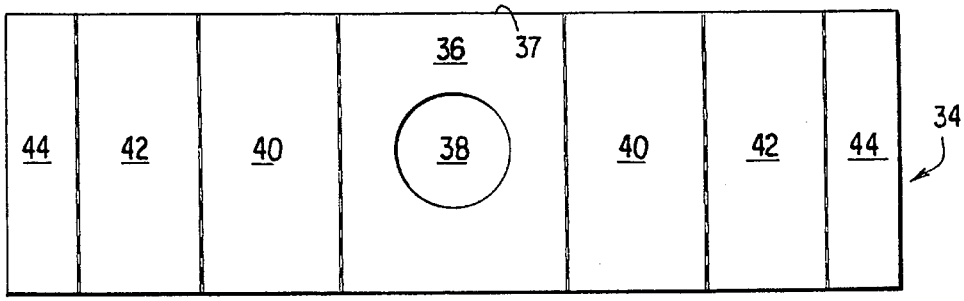

FIG. 3 is similar to FIG. 2 and shows another paperboard, generally rectangular blank 34 for forming another portion of the H shaped divider. Central panel 36 includes an opening 38, congruent with opening 24 of FIG. 2, and lateral panels 40, 42 and 44 joined by the indicated fold lines and extending laterally from both sides of central panel 36.

Instead of employing two separate blanks to form the H divider, the latter may be fashioned from one unitary blank, as by joining lower edge 23 of panel 22 to upper edge 37 of panel 36. In practice, this is effected by cutting a single blank to form an upper section similar to 20 of FIG. 2 and a lower section similar to 34 of FIG. 3, these two sections integrally hinged and joined only at regions 23 and 37.

Openings 24 of panel 20 and 38 of panel 36 are optional and may be omitted.

Figure 4:
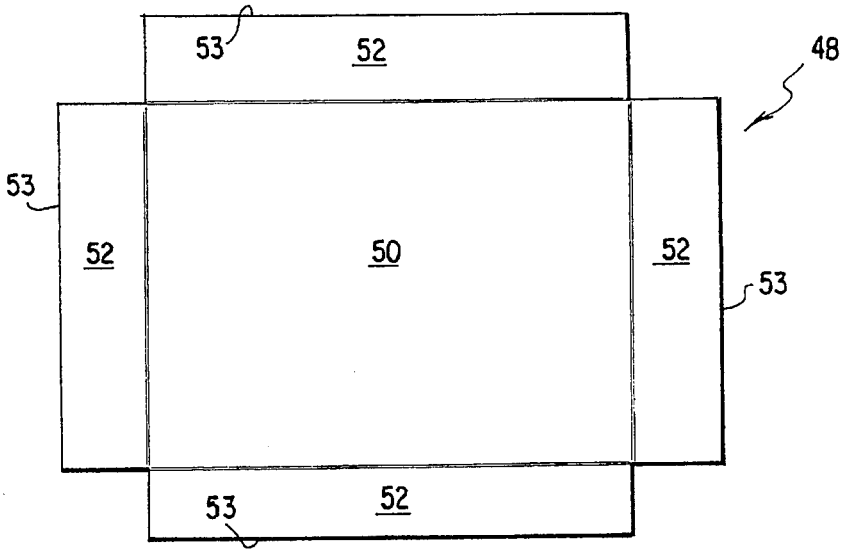
FIG. 4 is a plan view of a unitary blank of paperboard for forming the carton bottom closure.

FIG. 4 illustrates a unitary paperboard blank 48 for forming the bottom closure of the carton, the blank including a central panel 50 having side and end panels or flaps 52 foldably secured thereto by the indicated fold lines.

Figure 5:
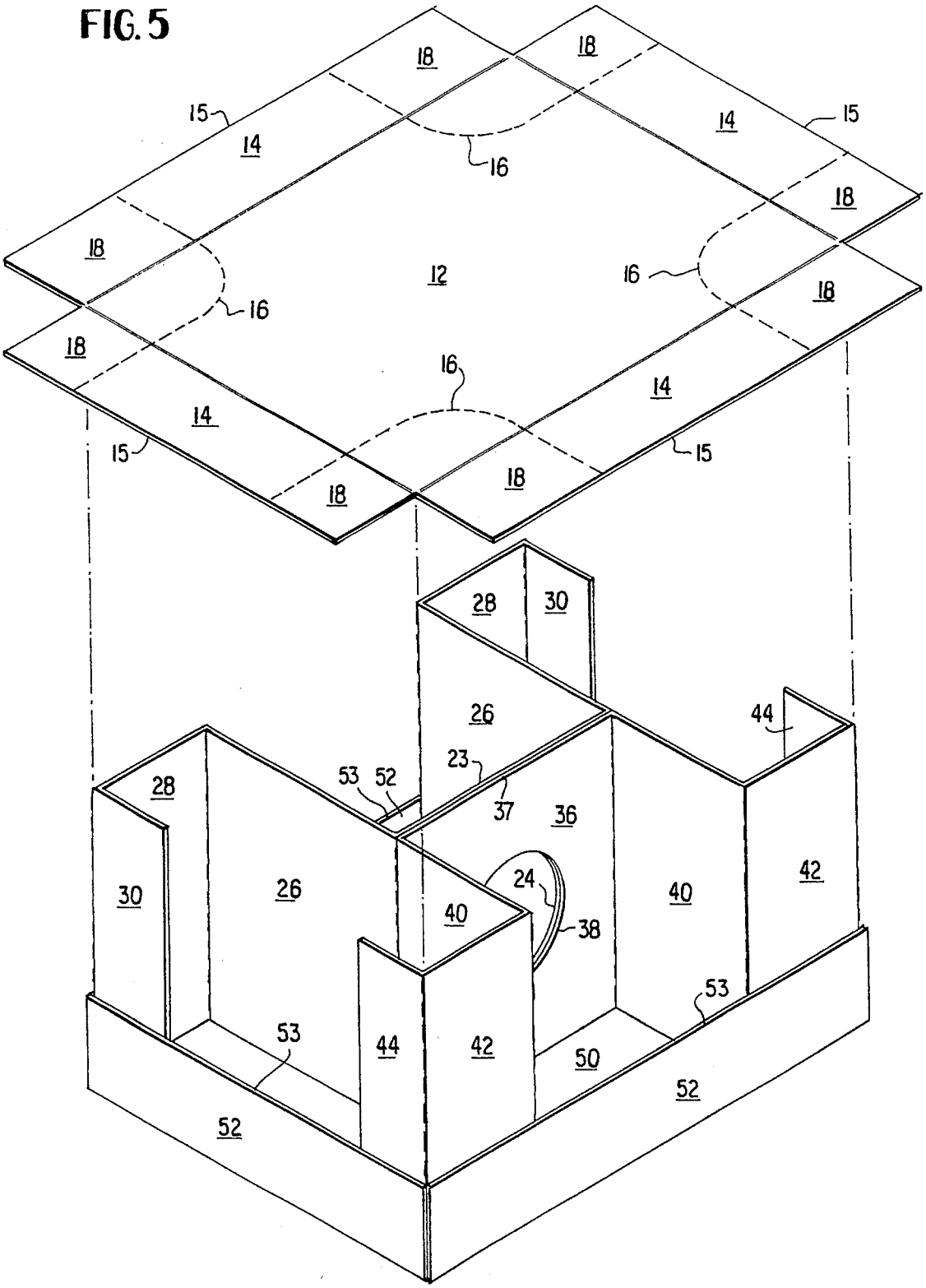
FIG. 5 is an exploded perspective view showing the H divider positioned within the bottom closure of the carton and showing the top closure elevated.

Referring now to FIG. 5, divider panels 20 and 34 have been glued together at respective central panels 22 and 36 so that the latter are in surface contact with other, with openings 24 and 38 being aligned. The gluing together of panels 22 and 36 is optional and may be omitted. Lateral panels 26, 28 and 30, as well as lateral panels 40, 42 and 44 are folded as indicated, with side and end panels 52 of bottom closure 48 glued to respective portions of lateral panels 28, 30, 42 and 44, the latter defining four L shaped posts at the corners. The L shaped posts are seen to be positioned at and integral with the ends of the divider. It is seen that the divider is generally H shaped as viewed from above. FIG. 5 illustrates the spatial relationship between optional top closure forming panel 10 and the remainder of the carton. As described above with respect to FIGS. 2 and 3, if the H divider is formed from a single blank, then edges 23 and 37 would be a single 180 degree fold. It is seen that lateral divider panels 30 and 44 of the L shaped posts each have a respective vertically extending free edge, with these free edges spaced from each other.

Figure 6:
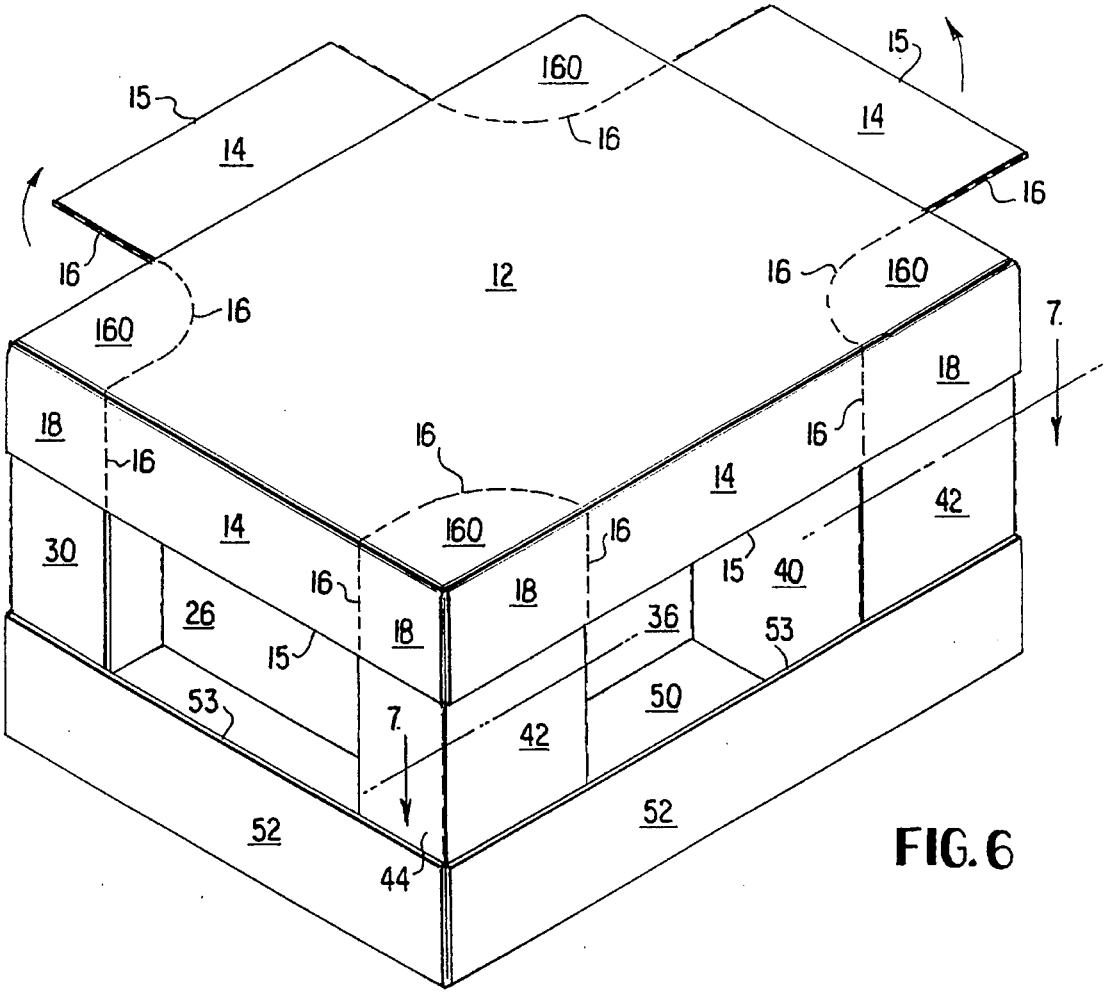
FIG. 6 is a perspective view showing the completed carton having two of the four top closure side panels ripped open.

FIG. 6 illustrates the container after it has been fully assembled and loaded with product, the latter not shown, with portions 18 of top closure forming panel 10 glued to the tops of respective L shaped corner posts after product loading. It is seen that perforated tear lines 16 span the downwardly extending side and end skirts or panels 14 of the top closure. It is also seen that vertically extending tear lines 16 on side and end panels 14 are aligned with respective free edges of L shaped posts defined by panels 42,44 and 28,30.

Figure 7:
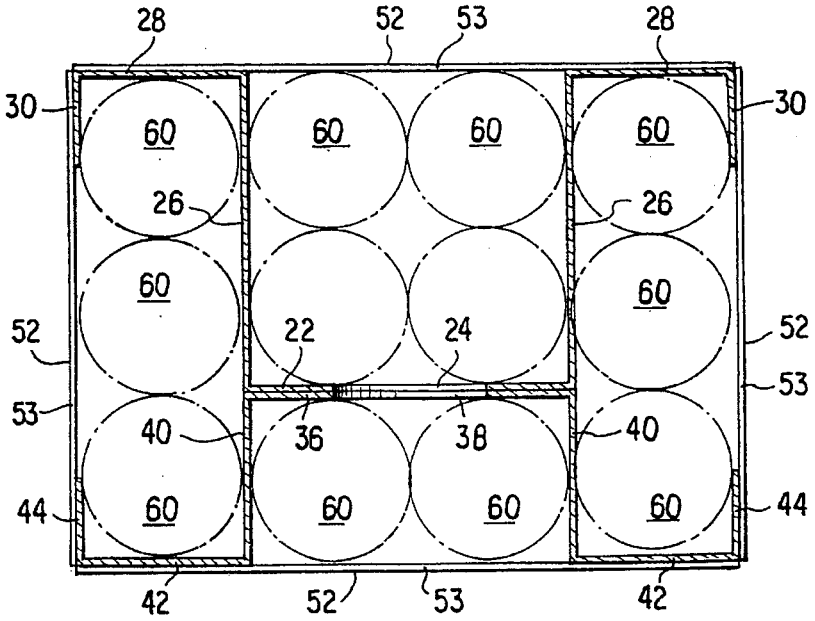
FIG. 7 is a view taken along section 7—7 of FIG. 6.

FIG. 7 illustrates a typical configuration of the H shaped divider panel, with individual product containers 60 shown in phantom lines and arranged as illustrated. Containers 60 are typically cylindrical and typically extend from top to bottom of the carton. The H divider may also be formed of identical sections 20 and 34 so that the horizontal bar of the H is midway of the vertical sides of the H. It is seen that the free edges 15 and 53 of respective top and bottom side and end panels or skirts 14 and 52 are vertically spaced from each other. The length of the horizontal middle or connecting bar portion of the H may be varied and the widths of the L shaped posts may also be varied so as to achieve a variety of packaging configurations or patterns of individual product containers 60.

If top closure 10 is omitted, then the fully loaded carton configuration would be that as shown at the lower part of FIG. 5, with individual containers 60 therein. The H divider configuration permits the cartons to be stacked in pallet loads, with or without top closure 10. The L shaped corners of the H divider provide a stable platform for stacking unitized pallet loads of product without top caps. This configuration in a pallet load creates a display-ready end of aisle unit. Further, if the top closure 10 is omitted, the ends 52 of the bottom 48 may be made longer than the sides 52 so that, as viewed in FIG. 5, ends 52 extend upwardly towards the tops of the L corner posts and beyond the upper free edges 53 of longitudinal sides 52. Such extensions would provide additional strength and would preclude panels 30 and 44 from bending inwardly if the package is shrink wrapped for shipping. A perforated tear line may be provided for such lengthened end panels to enable those portions thereof above the level of free ends 53 of longitudinal or side panels 52 to be torn away after shipment. Such a perforated tear line may extend entirely across the panel or can extend only between the vertical edges of L panels 30 and 44 to permit a central sector of the lengthened end panel 52 to be ripped away after shipment.

Figure 9:
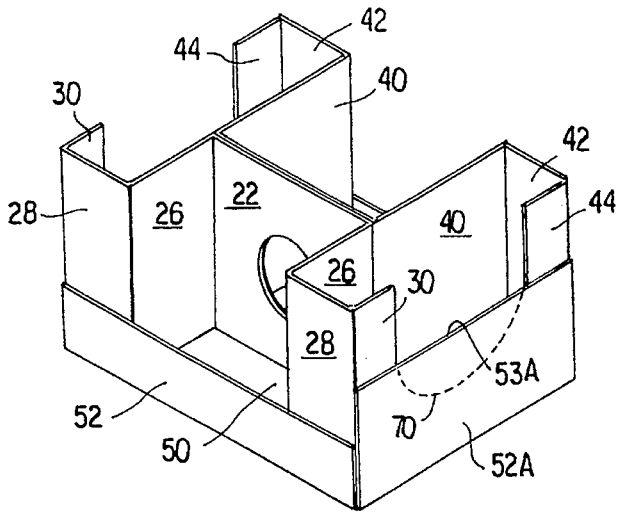
FIGS. 9 and 10 are perspective views of modified constructions of the carton particularly useful when shrink wrapping is employed.
Figure 10:
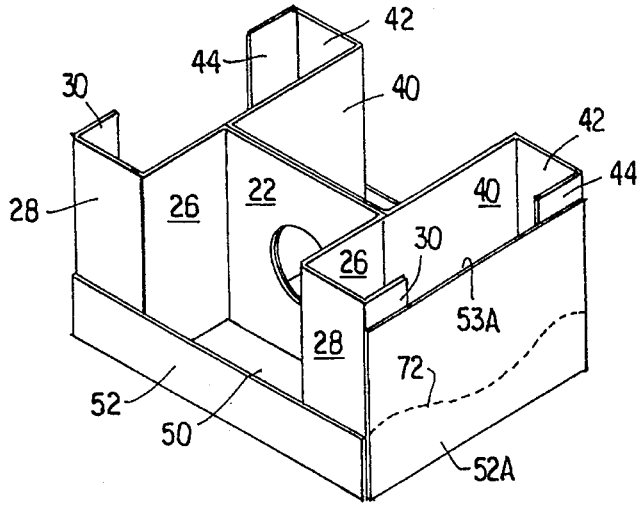

FIGS. 9 and 10 illustrate these alternative constructions, with end panels 52 there denoted as 52A and extending above the top free edges of side panels 52. At FIG. 9, the free edges 53A of end panels 52A extend about half way upwardly towards the top of the L corner posts, and downwardly curved perforated tear lines 70 extend between opposing free edges of panels 30 and 44 of the L posts. At FIG. 10, free edges 53A (only one being visible, as in FIG. 9) of end panels 52A extend upwardly to nearly the top of the L corner posts. A perforated tear line 72 extends all the way across the width of the end panels, and may be straight or may be curved as illustrated.

In the FIG. 9 construction, sector shaped regions above perforated lines 70 of end panels 52A may be removed by the retailer by ripping so as to further expose the carton contents. Similarly, end panel regions above perforated tear lines 72 in the construction of FIG. 10 may be removed by ripping for further carton contents display. The lateral edges of end panels 52A above perforated tear line 72 are not glued to panels 30 and 44 to thus permit easy tearing away. The height and tear line extent and configuration of end panels 52A may obviously be varied.

Figure 8:
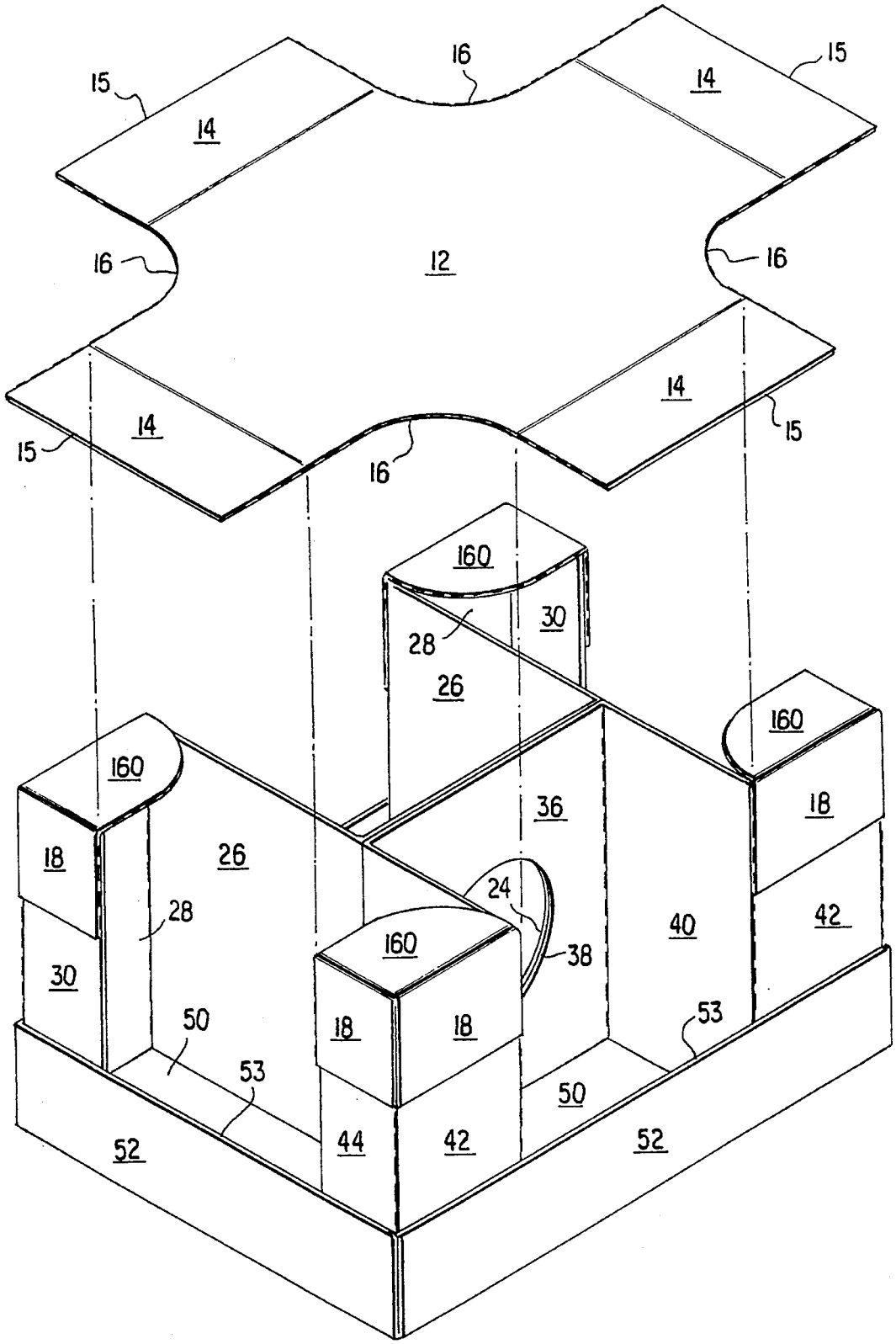
FIG. 8 is a perspective view of the carton and top closure after most of the top closure has been ripped away.

After the container has been received by a retailer, the cartons may be placed on display shelves or on the store floor, with each top closure removed by ripping the four middle, unglued portions of skirts 14 of each upwardly and then discarding the Maltese cross shape portion or section shown at the top of FIG. 8. The remainder of the carton then yields access to the product containers 60 indicated at FIG. 7, with the exception of the containers immediately beneath sections 160 of the top closure which have only side access. It will be observed that less carton material (paperboard) is used than with conventional shipping cartons.

Perforated lines 16 may be omitted from top closure 10, with the top closure being removed by cutting rather than by ripping along lines 16.

Aligned, but optional, openings 24 and 38 permit a retail consumer to visually determine the presence or absence of containers 60 on either side of the two contacting divider central panels 22 and 36 when the containers on one side of these panels are exhausted.

Figure 11:
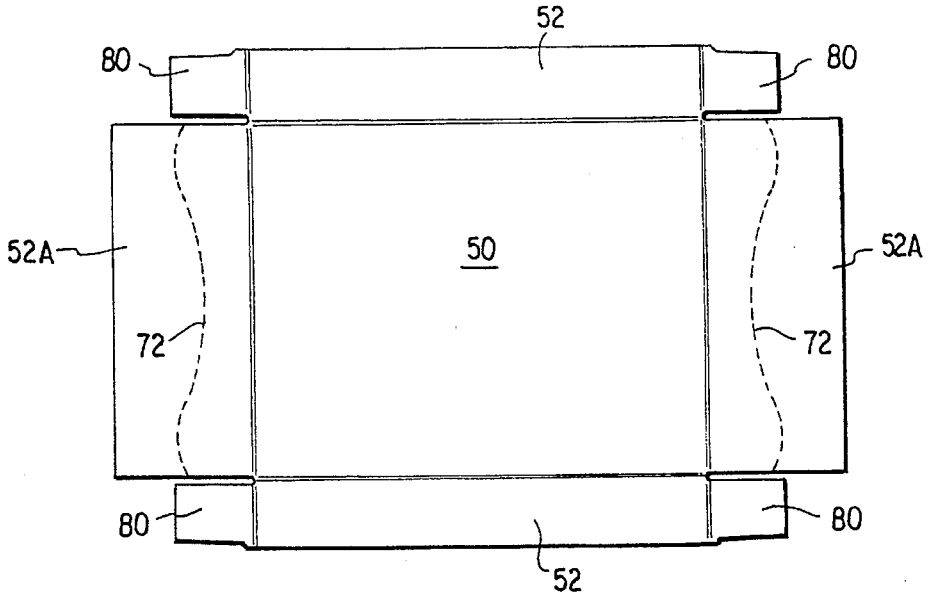
FIG. 11 is a plan view of a unitary paperboard blank for forming yet another modification of the carton of this invention.

Referring now to FIG. 11, a modified form of a unitary blank for forming the tray of the carton of this invention is illustrated. The tray formed from the blank is similar to that illustrated in FIG. 10, except for the addition of glue flaps or panels 80 at the longitudinal ends of side panels 52. The blank is set up and glued to form the tray illustrated at FIG. 12. It will be observed that glue panels or flaps 80 are glued to end wall panels 52A below each respective perforated tear line 72. FIG. 13 illustrates the previously described H divider placed into the bottom of the tray of FIG. 12. Glue is employed only between surfaces of panels 30 and 44 of the H divider and those portions of end panels 52A which are above respective perforated lines 72. This permits the tearing action illustrated at FIG. 14 wherein, upon receipt of the loaded carton (individual containers 60 not being illustrated), the retailer rips those portions of end walls 52A above perforated line 72 to separate them from respective lower portions of end walls 52A, thus permitting the H divider and the upper portions of end walls 52A (glued thereto) to be removed and lifted above the remaining portions of the tray. Individual containers 60 with product therein remain in the lower tray portion of FIG. 14.

I claim:

1. A rectangular paperboard shipping and display carton, said carton including a rectangular, horizontal top closure having four corners, a rectangular bottom closure having four corners, and a divider located between and extending vertically between said top and bottom closures, said closures each having vertically extending, peripheral side and end panels extending towards and spaced from each other, said carton having four corners, said divider including a vertical post at each of said four carton corners, said side and end panels having respective end portions thereof glued to portions of respective said divider posts, said top closure having a perforated tear line at each of its said four corners to thus define four top closure tear lines, said top closure tear lines each enclosing a respective corner portion of said top closure, said four perforated top closure tear lines extending to and downwardly spanning said top closure side and end panels, whereby middle portions of said top closure side and end panels can be ripped away from said glued end portions of said top closure side and end panels, to thereby remove said top closure except at said corner portions thereof.

2. The carton of claim 1 wherein said corner posts are L shaped.

3. The carton of claim 1 wherein said top closure perforated tear lines are curved.

4. The carton of claim 1 wherein said divider is H shaped.

5. The carton of claim 4 wherein said divider is formed of two unitary, folded paperboard blanks.

6. The carton of claim 4 wherein said divider is formed of a unitary blank.

7. The carton of claim 1 wherein said top and bottom closures are each formed from a respective unitary, folded paperboard blank.

8. The carton of claim 2 wherein said tear lines on said downwardly extending end and side panels of said top closure are aligned with respective free edges of said L shaped corner posts.

9. A rectangular paperboard shipping and display carton, said carton including a rectangular bottom closure having four corners, and a divider resting on said bottom closure and extending vertically upwardly, said bottom closure having upwardly extending peripheral side and end panels, said carton having four corners, said divider including a vertical post at each of said four carton corners, said side and end panels having respective end portions thereof glued to portions of respective said divider posts, said divider being H shaped and said vertical posts being L shaped and integral with ends of said H divider, wherein said divider extends above at least two of said peripheral end and side panels of said bottom closure and wherein said end panels extend above said side panels and wherein at least one of said end panels is provided with a perforated tear line which extends between said vertical posts.

10. The carton of claim 9 wherein said L shaped posts each have a free edge and said perforated tear line extends between respective said post free edges.

11. The carton of claim 9 wherein said perforated tear line extends across substantially the width of said end panel.

12. A rectangular paperboard shipping and display carton, said carton including a rectangular bottom closure having four corners, and a divider resting on said bottom closure and extending vertically upwardly, said bottom closure having upwardly extending peripheral side and end panels, said carton having four corners, said divider including a vertical post at each of said four carton corners, said divider extending above at least two of said peripheral end and side panels of said bottom closure, said end panels extending above said side panels, said end panels each provided with a perforated tear line which extends across substantially the entire width of said end panel, only those portions of said end panels above said perforated tear line glued to respective portions of said divider, whereby said divider can be removed from said carton by ripping said end panels above respective said perforated lines.

13. The carton of claim 12 wherein said divider is H shaped and wherein said vertical posts are L shaped and integral with ends of said H divider.

14. A rectangular paperboard shipping and display carton, said carton including a rectangular bottom closure having four corners, and a divider resting on said bottom closure and extending vertically upwardly, said bottom closure having upwardly extending peripheral side and end panels, said carton having four corners, said divider including a vertical post at each of said four carton corners, said side and end panels having respective end portions thereof glued to portions of respective said divider posts, said divider being H shaped and said vertical posts being L shaped and integral with ends of said H divider, said L shaped vertical posts having respective vertically extending free edges, said free edges being spaced from each other.

* * * * *